US009740148B2

(12) United States Patent
Cao et al.

(10) Patent No.: US 9,740,148 B2
(45) Date of Patent: Aug. 22, 2017

(54) METHOD AND SYSTEM FOR CONTROLLING A FUSER ASSEMBLY

(71) Applicant: Lexmark International, Inc., Lexington, KY (US)

(72) Inventors: Jichang Cao, Lexington, KY (US); James Douglas Gilmore, Georgetown, KY (US); David John Mickan, Lexington, KY (US); Kevin Dean Schoedinger, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 472 days.

(21) Appl. No.: 13/651,502

(22) Filed: Oct. 15, 2012

(65) Prior Publication Data

US 2014/0105628 A1 Apr. 17, 2014

(51) Int. Cl.
*G03G 15/20* (2006.01)

(52) U.S. Cl.
CPC . *G03G 15/2039* (2013.01); *G03G 2215/2035* (2013.01)

(58) Field of Classification Search
CPC ..... G03G 15/2039; G03G 2215/2035
USPC ..... 399/69, 70
See application file for complete search history.

(56) References Cited

U.S. PATENT DOCUMENTS

| | | | | |
|---|---|---|---|---|
| 4,081,213 | A | 3/1978 | Bar-on et al. | |
| 5,132,739 | A | 7/1992 | Mauer et al. | |
| 5,191,375 | A | 3/1993 | Hamilton | |
| 5,489,761 | A | 2/1996 | Aslam et al. | |
| 5,854,957 | A * | 12/1998 | Morikawa | 399/38 |
| 7,205,738 | B2 | 4/2007 | Chapman et al. | |
| 7,274,163 | B1 | 9/2007 | Lambert et al. | |
| 7,359,653 | B2 * | 4/2008 | Okamoto | 399/69 |
| 2003/0081962 | A1 * | 5/2003 | Murata | 399/69 |
| 2004/0202490 | A1 * | 10/2004 | Okamoto | 399/69 |
| 2004/0218942 | A1 * | 11/2004 | Gogate et al. | 399/67 |
| 2005/0163525 | A1 | 7/2005 | Watabe | |
| 2005/0260008 | A1 * | 11/2005 | Tatematsu et al. | 399/70 |
| 2006/0088330 | A1 * | 4/2006 | Fujita | 399/70 |
| 2006/0198651 | A1 * | 9/2006 | Tajima | 399/69 |
| 2006/0216077 | A1 * | 9/2006 | Komuro | 399/328 |
| 2007/0230984 | A1 * | 10/2007 | Noguchi | 399/69 |
| 2008/0131160 | A1 * | 6/2008 | Mitsuoka et al. | 399/70 |
| 2009/0142086 | A1 * | 6/2009 | Cao et al. | 399/69 |
| 2009/0238597 | A1 | 9/2009 | Cao et al. | |

(Continued)

OTHER PUBLICATIONS

Patent Cooperation Treaty (PCT), International Search Report for PCT Application PCT/US13/52525, dated Dec. 6, 2013.

(Continued)

*Primary Examiner* — David Bolduc

(57) ABSTRACT

A method and apparatus for providing a relatively short period of time for a fuser assembly to be ready to perform a fusing operation. Included is a fusing assembly having a heat transfer member and a backup member positioned to engage the heat transfer member so as to define a fusing nip therewith; and a controller coupled to the fuser assembly, wherein during a period of time when the fuser assembly is not performing a fusing operation, the controller activates the heat transfer member while causing the backup member to rotate at one or more relatively slow speeds relative to a fusing speed of the fuser assembly.

30 Claims, 6 Drawing Sheets

(56) References Cited

U.S. PATENT DOCUMENTS

| | | | | |
|---|---|---|---|---|
| 2009/0245837 | A1 | 10/2009 | Campbell et al. | |
| 2010/0054785 | A1* | 3/2010 | Ogiso et al. | 399/69 |
| 2011/0150518 | A1* | 6/2011 | Hase et al. | 399/70 |
| 2011/0194870 | A1 | 8/2011 | Hase et al. | |
| 2011/0280636 | A1* | 11/2011 | Nakamura et al. | 399/327 |
| 2012/0114359 | A1* | 5/2012 | Yura et al. | 399/70 |
| 2014/0169818 | A1 | 6/2014 | Cao et al. | |
| 2014/0212161 | A1 | 7/2014 | Cutts et al. | |

OTHER PUBLICATIONS

Patent Cooperation Treaty (PCT), Written Opinion of the International Searching Authority for PCT Application PCT/US13/52525, dated Dec. 6, 2013.

Prosecution history for United States Patent Application No. 13/719,713, filed Dec. 19, 2012, including Non-final Office Action dated Jul. 8, 2014 (5 pages).

* cited by examiner

METHOD AND SYSTEM FOR CONTROLLING A FUSER ASSEMBLY

CROSS REFERENCES TO RELATED APPLICATIONS

Pursuant to 35 U.S.C. §119, this application claims the benefit of the earlier filing date of Provisional Application Ser. No. 61/676,892, filed Jul. 27, 2012, entitled "Improved Method and Apparatus for Controlling a Fuser Assembly," and Provisional Application Ser. No. 61/705,847, filed Sep. 26, 2012, entitled "A Method and System for Controlling a Fuser Assembly," the contents of which are hereby incorporated by reference herein in their entirety. This application is also related to U.S. Pat. Nos. 7,205,738 and 7,274,163, both of which are assigned to the assignee of this application, the contents of which are hereby incorporated by reference herein in their entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to controlling a fuser assembly in an electrophotographic imaging device, such as a laser printer or multifunction device having printing capability, and particularly to maintaining sufficient energy levels within a fuser assembly for a period of time when not performing a fusing operation so as to allow for relatively short time to reach fusing temperatures without substantially increasing overall energy usage by the imaging device.

2. Description of the Related Art

Manufacturers of printing devices are continuingly challenged to improve printing device performance. One way in which improvement is sought is with respect to achieving a shorter time to printing a first media sheet of a print job (hereinafter "first print time"). To deliver improved first print times, one approach is for laser printers to keep its fuser assembly, i.e., the assembly which fuses deposited toner into a sheet of media, heated at a relatively warm temperature less than a temperature for fusing toner. Such an approach has been met with some success but even shorter first print times are nevertheless desired.

SUMMARY

Example embodiments overcome shortcomings of existing laser printing devices and thereby satisfy a significant need for controlling a fuser assembly to yield a reduced first print time in a relatively energy efficient manner. According to one example embodiment, an imaging device includes a fuser assembly having a heat transfer member and a backup roll positioned to engage the heat transfer member thereby defining a fusing nip therewith. A controller controls the fuser assembly such that following the occurrence of at least one event within the imaging device and during a period of time when the fuser assembly is not performing a fusing operation, the controller activates the heat transfer member while controlling the backup roll to rotate at a relatively slow speed relative to a fusing speed of the fuser assembly. Slowly rotating the backup roll while heating the heat transfer member during a period when toner fusing does not occur advantageously ensures that the backup roll stores an acceptable amount of energy to allow the fuser assembly to quickly reach a state for fusing toner to media sheets.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
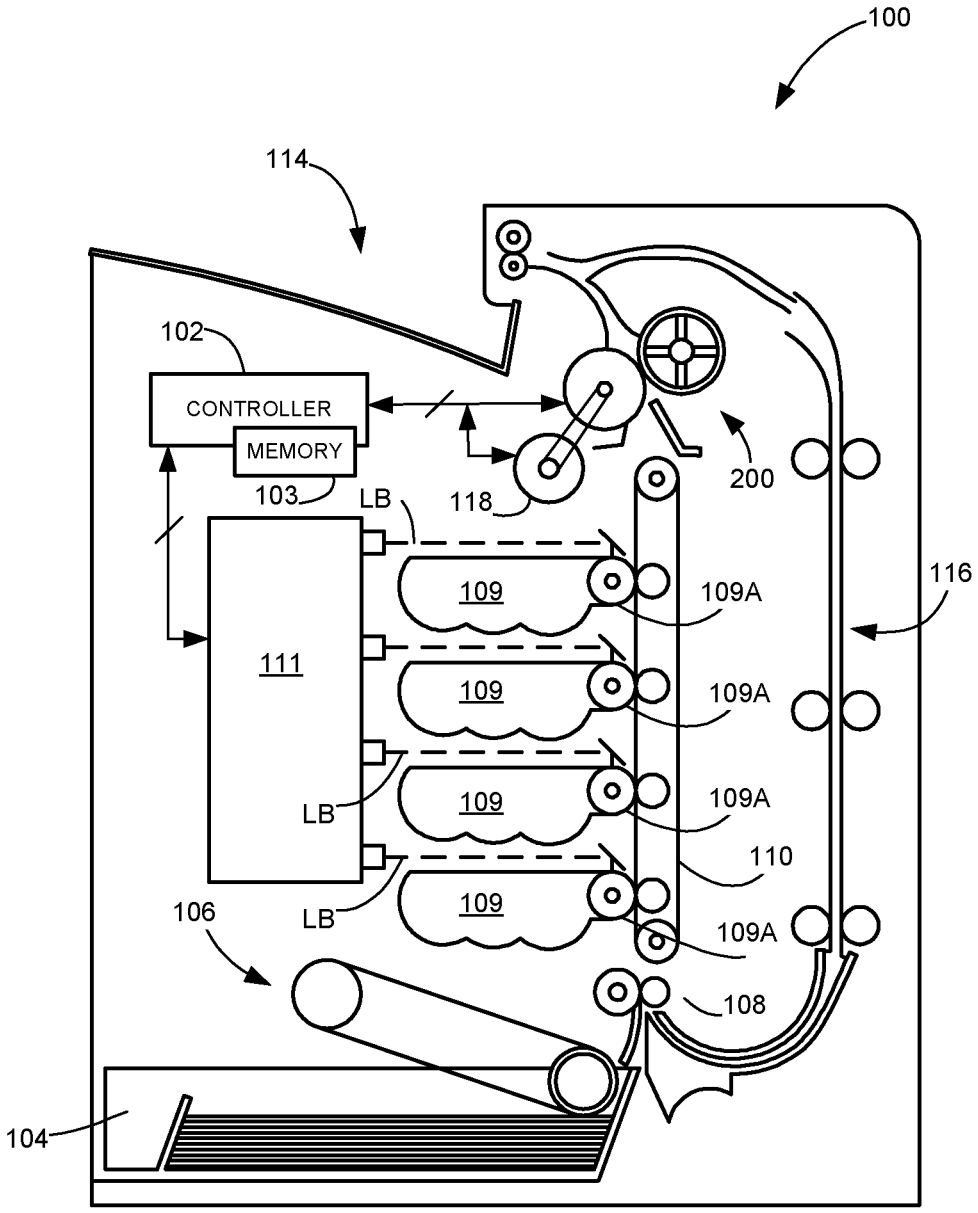
FIG. 1 is a side elevational view of an improved imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

Referring now to the drawings and particularly to FIG. 1, there is shown an imaging device in the form of a color laser printer, which is indicated generally by the reference numeral 100. An image to be printed is typically electronically transmitted to a processor or controller 102 by an external device (not shown) or the image may be stored in a memory 103 embedded in or associated with the controller 102. Memory 103 may be any volatile and/or non-volatile memory such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may include one or more processors and/or other logic necessary to control the functions involved in electrophotographic imaging.

In performing a print operation, controller 102 initiates an imaging operation in which a top media sheet of a stack of media is picked up from a media or storage tray 104 by a pick mechanism 106 and is delivered to a media transport apparatus including a pair of aligning rollers 108 and a media transport belt 110 in the illustrated embodiment. The media transport belt 110 carries the media sheet along a media path past four image forming stations 109 which apply toner to the media sheet through cooperation with laser scan unit 111. Each imaging forming station 109 provides toner forming a distinct color image plane to the media sheet. Laser scan unit 111 emits modulated light beams LB, each of which forms a latent image on a photoconductive surface or drum 109A of the corresponding image forming station 109 based upon the bitmap image data of the corresponding color plane. The operation of laser scan units and imaging forming stations is known in the art such that a detailed description of their operation will not be provided for reasons of expediency.

Fuser assembly 200 is disposed downstream of image forming stations 109 and receives from media transport belt 110 media sheets with the unfused toner images superposed thereon. In general terms, fuser assembly 200 applies heat and pressure to the media sheets in order to fuse toner thereto. After leaving fuser assembly 200, a media sheet is either deposited into output media area 114 or enters duplex media path 116 for transport to the most upstream image forming station 109 for imaging on a second surface of the media sheet.

Imaging device 100 is depicted in FIG. 1 as a color laser printer in which toner is transferred to a media sheet in a single transfer step. Alternatively, imaging device 100 may be a color laser printer in which toner is transferred to a media sheet in a two step process—from image forming stations 109 to an intermediate transfer member in a first step and from the intermediate transfer member to the media sheet in a second step. In another alternative embodiment, imaging device 100 may be a monochrome laser printer which utilizes only a single image forming station 109 for depositing black toner to media sheets. Further, imaging device 100 may be part of a multi-function product having, among other things, an image scanner for scanning printed sheets.

Figure 2:
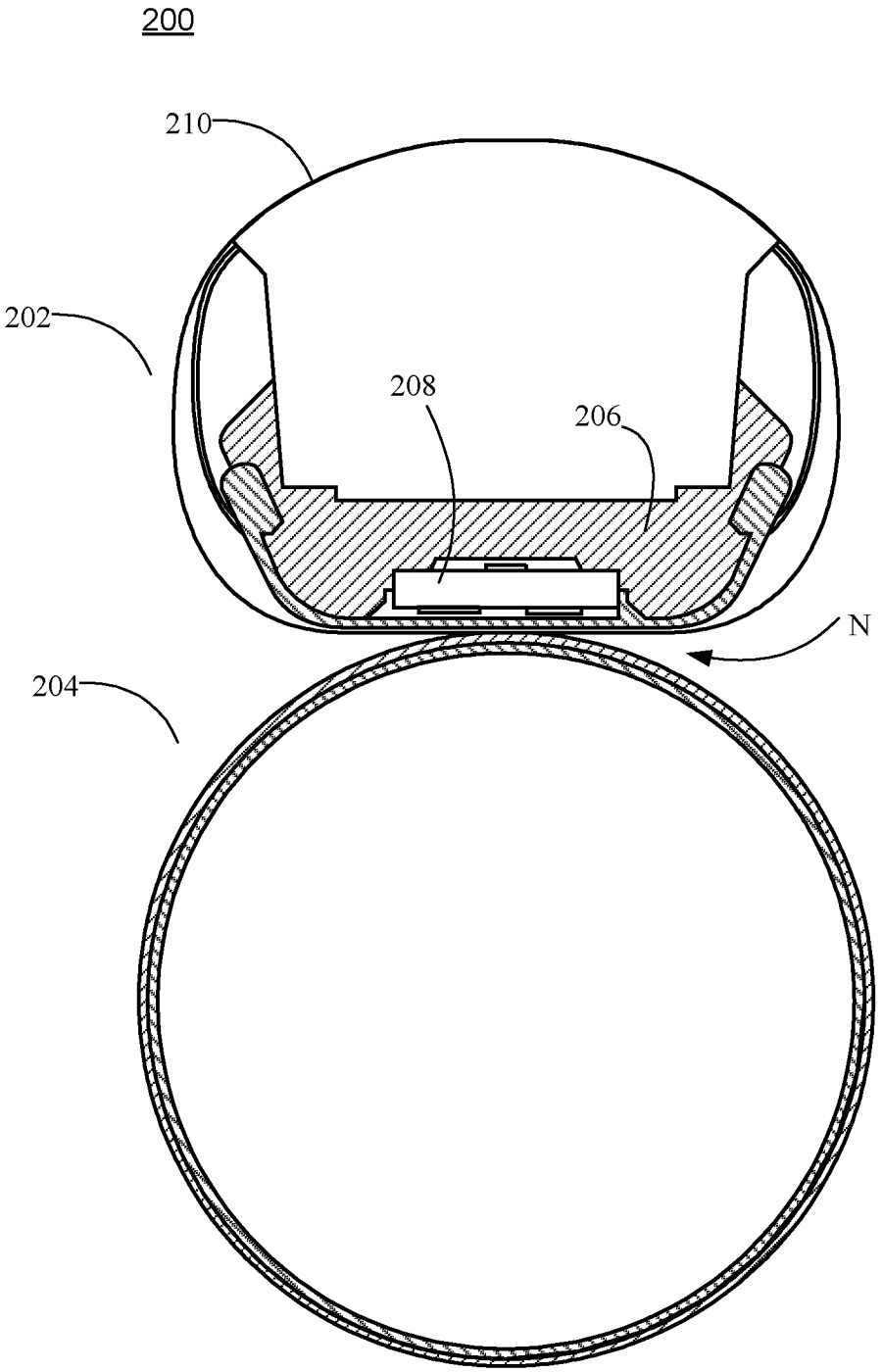
FIG. 2 is a cross sectional view of a fuser assembly of FIG. 1.

With respect to FIG. 2, fuser assembly 200 may include a heat transfer member 202 and a backup roll 204 cooperating with the heat transfer member 202 to define a fuser nip N for conveying media sheets therein. The heat transfer member 202 may include a housing 206, a heater element 208 supported on or at least partially in housing 206, and an endless flexible fuser belt 210 positioned about housing 206. Heater element 208 may be formed from a substrate of ceramic or like material to which one or more resistive traces is secured which generates heat when a current is passed through the resistive traces. Heater element 208 may further include at least one temperature sensor, such as a thermistor, coupled to the substrate for detecting a temperature of heater element 208. It is understood that heater element 208 alternatively may be implemented using other heat generating mechanisms.

Fuser belt 210 is disposed around housing 206 and heater element 208. Backup roll 204 contacts fuser belt 210 such that fuser belt 210 rotates about housing 206 and heater element 208 in response to backup roll 204 rotating. With fuser belt 210 rotating around housing 206 and heater element 208, the inner surface of fuser belt 210 contacts heater element 208 so as to heat fuser belt 210 to a temperature sufficient to perform a fusing operation to fuse toner to sheets of media.

Heat transfer member 202 and backup roll 204 may be constructed from the elements and in the manner as disclosed in U.S. Pat. No. 7,235,761, the content of which is incorporated by reference herein in its entirety. It is understood, though, that fuser assembly 200 may have a different architecture than a fuser belt based architecture. For example, fuser assembly 200 may be a hot roll fuser, including a heated roll and a backup roll engaged therewith to form a fuser nip through which media sheets traverse.

Figure 3:
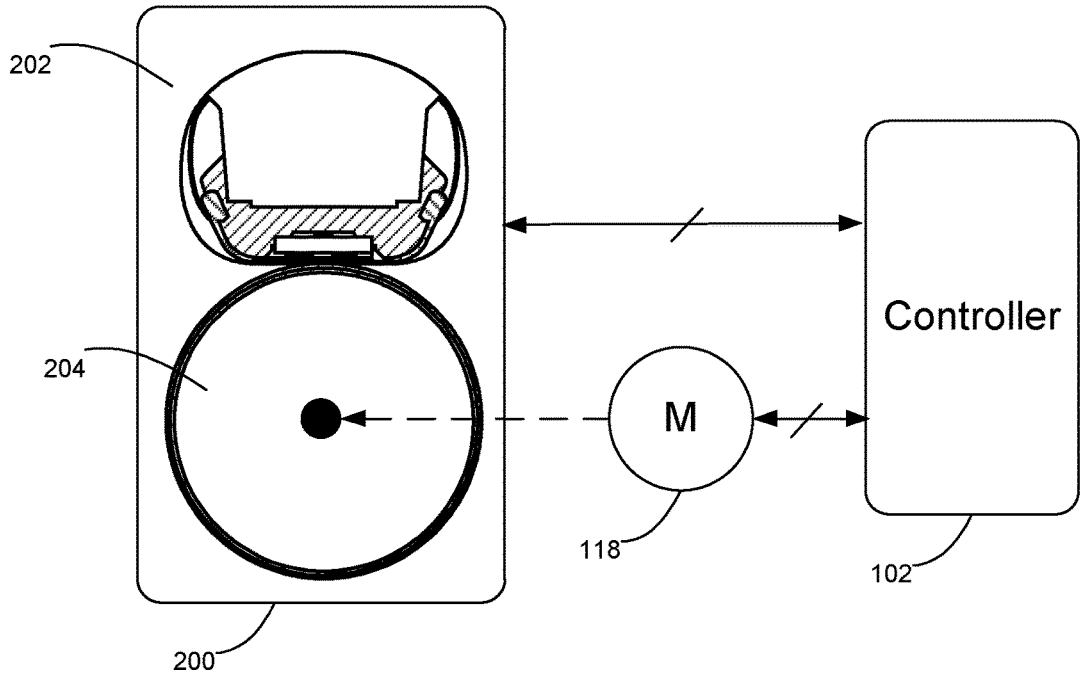
FIG. 3 is a block diagram illustrating electrical and mechanical coupling between components of the imaging device of FIG. 1.

Backup roll 204 may be driven by motor 118 (FIG. 1). Motor 118 may be any of a number of different types of motors. For instance, motor 118 may be a brushless D.C. motor or a stepper motor. Motor 118 may be coupled to backup roll 204 by any of a number of mechanical coupling mechanisms, including but not limited to a gear train (not shown). For simplicity, FIG. 3 represents the mechanical coupling between motor 118 and backup roll 204 as a dashed line. FIG. 3 also illustrates the communication between controller 102, motor 118 and fuser assembly 200. In particular, controller 102 generates control signals for controlling the movement of motor 118 and the temperature of heater element 208. Controller 102 may control motor 118 and heater element 208 during a fusing operation, for example, based in part upon feedback signals provided thereby. It is understood that additional circuitry may be disposed between controller 102, motor 118 and fuser assembly 200, including but not limited to driver circuitry for suitably conditioning control signals for driving motor 118 and heating heater element 208.

During a fusing operation, controller 102 controls heater element 208 to generate heat within a desired range of fusing temperatures. In addition, controller 102 controls motor 118 to cause backup roll 204 to rotate at a desired fusing speed during a fusing operation. The desired fusing speed and range of fusing temperatures are selected for achieving relatively high processing speeds and effective toner fusing without appreciably affecting the useful life of, for example, fuser belt 210 and backup roll 204. Processing speeds and useful life are two performance based characteristics often associated with fuser assemblies.

In addition, the first print time is another performance based characteristic associated with imaging devices and, as a result, fuser assemblies. Because fuser assemblies need time in order to be heated to a fusing temperature prior to performing a fusing operation, the heating performance of a fuser assembly is often a contributing factor in an imaging device achieving an acceptable first print time. To be able to meet small first print times while providing acceptable levels of toner fusing, a sufficient amount of thermal energy may be stored in fuser assembly 200 prior to a media sheet reaching fuser nip N of the fuser assembly. Controller 102 generally controls fuser assembly 200 during times when fuser assembly 200 is not performing a fusing operation so as to maintain a sufficient amount of thermal energy in backup roll 204 and enable the temperature in fuser nip N of fuser assembly 200 to quickly reach fusing temperatures. This time may be seen as a standby mode for imaging device 100 and/or fuser assembly 200.

According to an example embodiment, when in a standby mode controller 102 activates heater element 208 to heat to a predetermined temperature while controller 102 controls motor 118 to cause backup roll 204 to relatively slowly rotate. By heating fuser assembly 200 while slowly rotating backup roll 204 during periods when fuser assembly is not performing a fusing operation, a sufficient amount of thermal energy is maintained generally uniformly throughout backup roll 204 such that the first print time is substantially reduced.

In an example embodiment, controller 102 controls heater element 208 to heat at a predetermined temperature less than a fusing temperature. For example, the predetermined temperature may be between about 140 degrees C. and about 180 degrees C., and particularly between about 150 degrees C. and about 170 degrees C., such as about 160 degrees C. It is understood, however, that the particular temperature at which heater element 208 may be heated during the time when backup roll 204 slowly rotates and when fuser assembly is not performing a fusing operation may vary and depend upon a number of target performance factors, including speed, energy consumption and fuser life based factors.

As mentioned, during the standby mode controller 102 may control motor 118 to cause backup roll 204 to relatively slowly rotate while heater element 208 is heated to a temperature less than a fusing temperature. In an example embodiment, controller 102 may control motor 118 to cause backup roll 204 to rotate between about 0.2 revolutions per minute (rpm) and about 10 rpm, and more particularly between about 0.4 rpm and about 2.5 rpm, such as about 0.5 rpm. Such slow rotational speeds represent a small fraction of a fusing speed, i.e., a speed of backup roll 204 when fuser assembly 200 is performing a fusing operation. For example, the slow rotational speeds of backup roll 204 may be about 1/250 to about 1/500 of a fusing speed for fuser assembly 200. In an alternative embodiment, the rotational speed of backup roll 204 may be less than about 15 rpm. In yet another alternative embodiment, the speed of backup roll 204 may vary in a predetermined manner. It is understood that backup roll 204 may be rotated at other rotational speeds and the particular speed or speeds may be selected based upon a number of target performance factors, including speed, energy consumption and fuser life based factors. It is further understood that in an alternative embodiment, heater element 208 may be heated during the standby mode by controller 102 to a temperature at or greater than the fusing temperature. In yet another embodiment, heater element 208 may be heated during the standby mode to a temperature below the fusing temperature during one portion of the standby mode and a temperature at or above the fusing temperature during another portion of the standby mode.

The way in which backup roll 204 is relatively slowly rotated may vary. In an example embodiment, controller 102 may control motor 118 to substantially continuously rotate backup roll 204. In another example embodiment, controller 102 may control motor 118 to rotate backup roll 204 in a series of discrete and/or discontinuous movements. Each such movement may be identical to each other or may vary therefrom in duration, rotational speed and/or distance.

In an example embodiment, for a predetermined period of time controller 102 may control heater element 208 to be heated to a predetermined temperature less than a fusing temperature while controlling motor 118 to cause backup roll 204 to relatively slowly rotate. Imaging device 100 may include timer circuitry (not shown) which may be part of controller 102 or a separate circuit that is coupled thereto. The period of time may be a fixed, predetermined period of time. For example, the predetermined period of time may be between about three minutes and about 15 minutes, and particularly between about four minutes and about ten minutes, such as about five minutes. It is understood that the predetermined period of time may be another time period, and that the selection of a time period may be based upon a number of target performance factors for imaging device 100, including speed, energy consumption and fuser life based factors. Further, the period of time may vary based upon one or more environmental conditions of imaging device 100, such as temperature and relative humidity.

Imaging device 100 may enter the standby mode in which controller 102 controls the temperature of heater element 208 and controls motor 118 so that backup roll 204 rotates at a relatively slow rate following the occurrence of any one of a number of events. For instance, the standby mode may be entered into after imaging device 100 has completed a power on reset operation, a general warm-up operation, or a printing operation in which one or more sheets of media is printed. Other events triggering entry into this standby mode may include opening or closing a cover or door of imaging device 100 and reception of a user request to continue printing following a paper jam condition. It is understood that the above mentioned events are merely illustrative and are not intended to be limiting such that other events may cause imaging device 100 to enter the standby mode.

By controlling the rotation of backup roll 204 to relatively slowly rotate for a predetermined period of time and activating heater element 208 to heat to a predetermined temperature less than a fusing temperature without using temperature or other feedback in the speed control of backup roll 204, controller 102 operates in an open loop manner during this time when in the standby mode. During the predetermined period of time, motor 118 may be operated using time-based commutation. For example, controller 102 may include the functionality described in U.S. Pat. Nos. 7,205,738 and/or 7,274,163, the contents of which are hereby incorporated by reference herein in their entirety. In an example embodiment, imaging device 100 may utilize time-based commutation for relatively slowly rotating backup roll 204. Specifically, controller 102 may include or be coupled to commutation logic circuitry utilizing one or more lookup tables, with each addressable location in a lookup table maintaining a motor drive value corresponding to a discrete position of motor 118. The motor drive values in a lookup table may then be used in generating the drive signals for motor 118 for a single commutation cycle thereof. In the example embodiment, at least one lookup table maintains motor drive values so that the current flowing in any of the windings of motor 118 follows a generally sinusoidal waveform.

As discussed, during the standby mode controller 102 may control motor 118 in an open loop manner. Controller 102 may control heater element 208 during the standby mode in either an open loop manner, a closed loop manner or both so as to control the temperature of fuser assembly 200. For open loop control of heater element 208, controller 102 may supply a predetermined portion of available power to heater element 208 for heating same, such as between about 10% and about 20%, for example. The amount of the predetermined portion of available power to be supplied to heater element 208 may be chosen to be sufficiently low to ensure that components of fuser assembly 200 do not overheat during standby mode. Application of power to heater element 208 during open loop control may be substantially continuous or cycled between full power and no power. For closed loop control of heater element 208, the temperature of heater element 208 is fed back to controller 102 for use in controlling the temperature of heater element 208.

An operation of imaging device 100 will now be described with reference to FIG. 4, according to an example embodiment. It is understood that the order of the acts described hereinbelow is presented for illustrative purposes only, and that the acts may be ordered in a different manner. At 402, a determination is made, such as by controller 102, whether any one of a number of predetermined events has occurred. As mentioned, such events may occur when fuser assembly 200 is not performing a fusing operation and may include but are not limited to the completion of a printing operation or reset operation, opening or closing of a cover or door of imaging device 100, the completion of a paper jam condition or an estimate by controller 102 that backup roll 204 has fallen below a second predetermined temperature. Upon an affirmative determination that a predetermined event has occurred, imaging device 100 enters the standby mode in which the temperature of heater element 208 is heated at 404 to a predetermined temperature less than a fusing temperature, and backup roll 204 is initially slowly rotated at 406. The timer circuitry may be activated at 408 to begin counting. During the time heater element 208 is heated to the predetermined temperature and backup roll 204 is slowly rotated, thermal energy is maintained substantially throughout backup roll 204. Depending upon the predetermined temperature of heater element 208 and the rotational speed of backup roll 204, the thermal energy may be maintained in backup roll 204 substantially uniformly.

The heating and slow rotating continues until the timer circuitry indicates that the predetermined period of time has elapsed, at which point the timer may be deactivated at 410, and rotation of backup roll 204 and heating of heater element 208 may cease at 412 or otherwise be changed to reflect entry by imaging device 100 into a different mode of operation. In addition, the fuser nip N may be opened. At this point, if imaging device 100 has not entered a printing mode of operation and/or if fuser assembly 200 has not entered a fusing mode of operation to fuse toner to a media sheet, controller 102 may wait for the next occurrence of a predetermined event.

Figure 4:
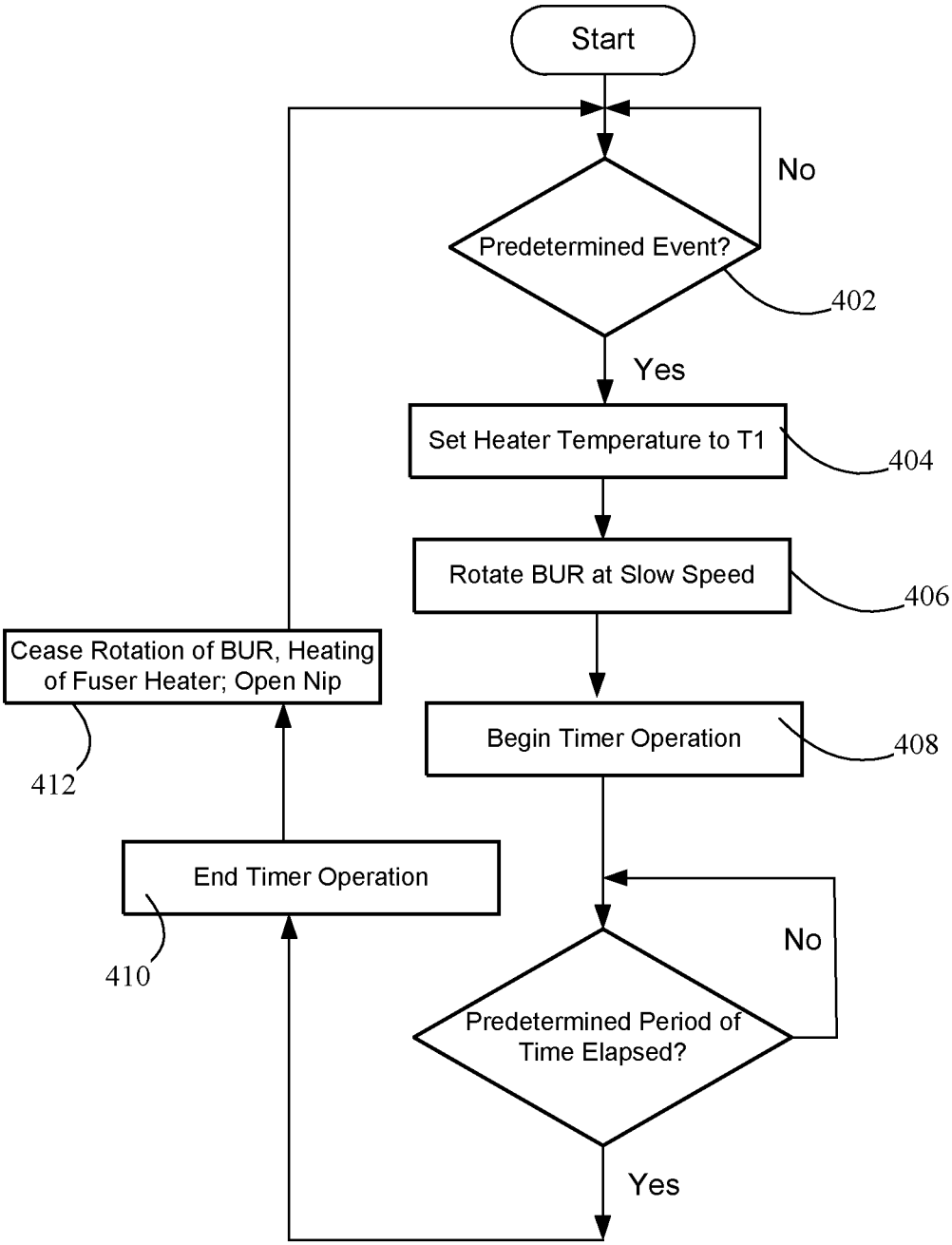
FIG. 4 is a flowchart illustrating a method of controlling the fuser assembly of FIG. 2 according to an example embodiment.

It is understood that fuser assembly 200 may be controlled in an open loop manner using a process different from the process of FIG. 4. For instance, instead of using timing circuitry for identifying the completion of the time duration during which imaging device 100 and/or fuser assembly 200 is in the above-described standby mode, controller 102 may determine such duration based upon the number of revolutions of backup roll 204.

In another alternative embodiment, imaging device 100 may enter the standby mode based at least in part upon backup roll 204 being estimated by controller 102 to have fallen below, or is otherwise below, a second predetermined temperature, and remain in the standby mode until controller 102 estimates that the temperature of backup roll 204 has reached a third predetermined temperature greater than the second predetermined temperature. The second predetermined temperature may be, for example, a temperature between about 55 degrees C. and about 85 degrees C., and particularly between about 65 degrees C. and about 75 degrees C., such as about 70 degrees C. The third predetermined temperature may be a temperature that is greater than the second predetermined temperature by an amount between about 10 degrees C. and about 40 degrees C., such as about 20 degrees C., for example. When in the standby mode, controller 102 may cause backup roll 204 to relatively slowly rotate and control heater element 208 to heat at the third predetermined temperature or at a fourth predetermined temperature greater than the third predetermined temperature. The relatively slow rotation of backup roll 204 may be at a speed discussed above, or at speeds between about 10 rpm and about 40 rpm, and particularly between about 15 rpm and about 35 rpm, such as about 25 rpm. The fourth predetermined temperature may be between about 10 degrees C. and about 50 degrees C. greater than the third predetermined temperature. It is understood that the fourth predetermined temperature may be based upon other factors. The temperature estimates of backup roll 204 by controller 102 may be based at least in part upon known thermal characteristics of heating element 208, fuser belt 210 and backup roll 204, the rotational speed of backup roll 204 and the fourth predetermined temperature.

Figure 5:
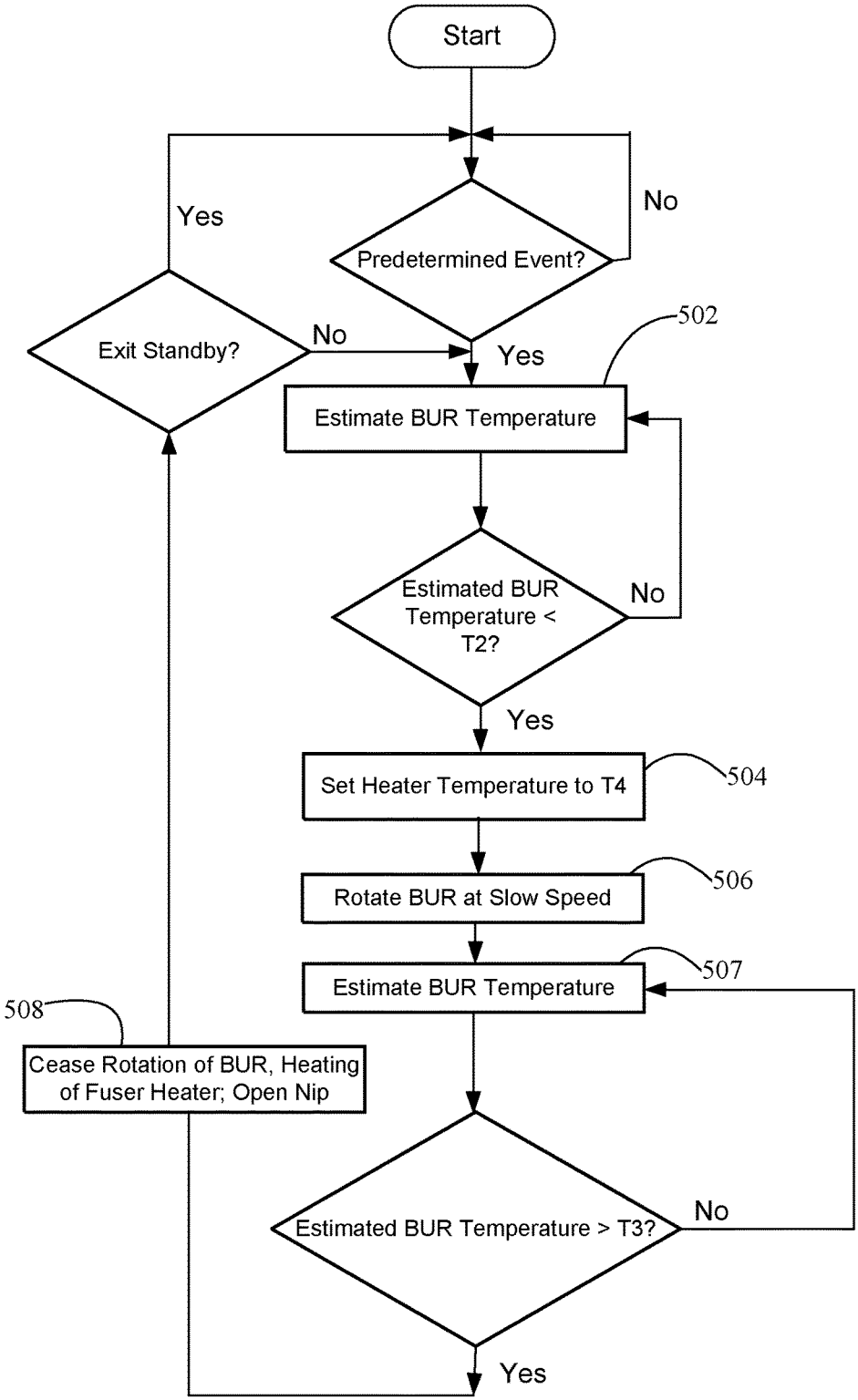
FIG. 5 is a flowchart illustrating a method of controlling the fuser assembly of FIG. 2 according to another example embodiment.

The operation of the above mentioned alternative embodiment will be described with respect to FIG. 5. Following entry into the standby mode, at 502 controller 102 estimates the temperature of backup roll 204. The estimate may be based at least in part upon a last known, measured temperature of backup roll 204, the time duration since the last temperature measurement was made, thermal characteristics of backup roll 204 and fuser belt 210, and any intervening factors such as subsequently heating heater element 208 for a period of time. If the estimated temperature of backup roll 204 is less than the second predetermined temperature, controller 102 activates at heater element 208 at 504. At around the same time, controller 102 controls motor 118 to relatively slowly rotate backup roll 204 at 506. The heating and slow rotating results in the temperature of backup roll 204 increasing. Controller 102 then estimates at 507 whether the temperature of backup roll 204 has surpassed the third predetermined temperature. If so, at 508 controller 102 causes backup roll 204 to no longer slowly rotate and heater element 208 to no longer be activated for generating heat. In addition, fuser nip N may be opened at that time. Alternatively, though backup roll 204 may be no longer slowly rotated, heater element 208 may continue to be activated to generate heat. Thereafter, if imaging device 100 remains in the standby mode, the process may be repeated, beginning at 502.

Figure 6:
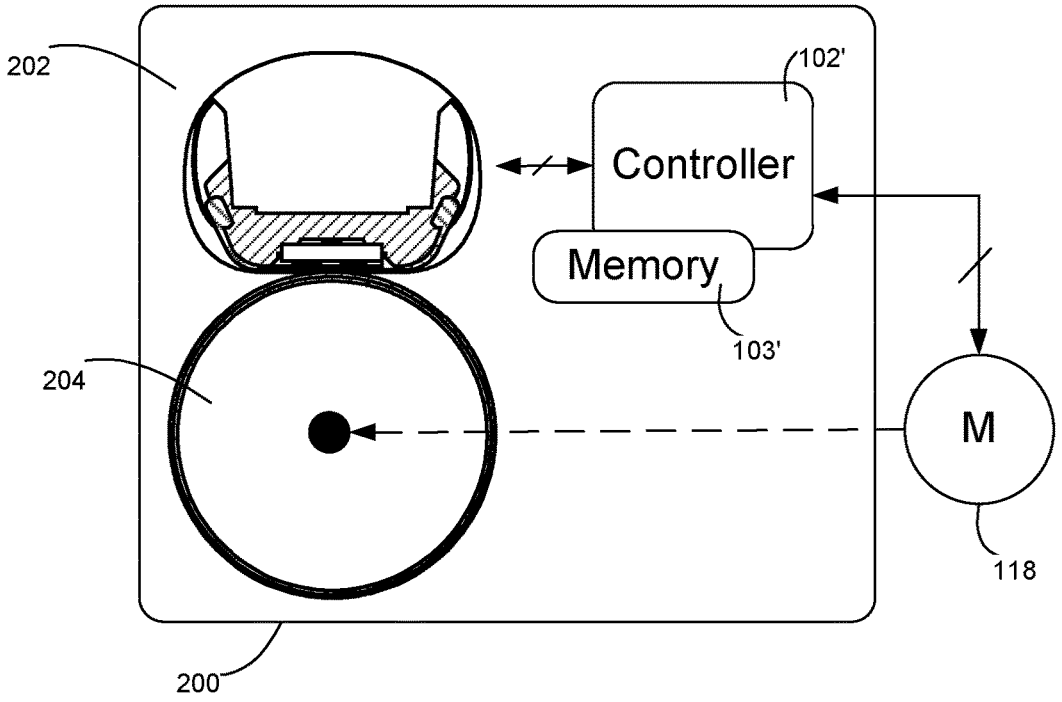
FIG. 6 is a block diagram illustrating electrical and mechanical coupling between components of the imaging device of FIG. 1 according to an alternative embodiment.

As mentioned, controller 102 may be implemented using one or more processors. FIG. 6 depicts one such processor or controller 102' and memory 103' coupled thereto, mounted and/or physically connected to fuser assembly 200, in accordance with an example embodiment. Controller 102' may generally control the operation of motor 118 and fuser assembly 200, and controller 102 may control the operation of other components and assemblies within imaging device 100.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An apparatus, comprising:

a fuser assembly comprising a heat transfer member, a backup member positioned to engage the heat transfer member thereby defining a fusing nip therewith; and a controller coupled to the fuser assembly, wherein during a period of time when the fuser assembly is not performing a fusing operation, the controller activates the heat transfer member while causing the backup member to rotate at at least one relatively slow speed relative to a fusing speed of the fuser assembly, wherein prior to the controller activating the heat transfer member and causing the backup member to rotate at the at least one relatively slow speed, the controller estimates whether a temperature of the backup member is below a predetermined temperature, the controller activating the heat transfer member and causing the backup member to relatively slowly rotate responsive to an affirmative estimation, the estimation based at least upon a last measurement of the temperature of the backup member and a time duration since the last measurement of the temperature of the backup member.

2. The apparatus of claim 1, wherein the controller is physically mounted to the fuser assembly.

3. The apparatus of claim 1, wherein the at least one relatively slow speed is between about 0.4 revolutions per minute (rpm) and about 25 rpm.

4. The apparatus of claim 1, wherein the controller causes the backup member to rotate at the at least one relatively slow speed for a predetermined period of time.

5. The apparatus of claim 4, wherein the predetermined period of time is between about three and about 15 minutes.

6. The apparatus of claim 1, wherein following the heat transfer member being activated and the backup member being rotated, the controller estimates whether a temperature of the backup member is above a predetermined temperature, and responsive to an affirmative estimation ceases activating the heat transfer member and causing the backup member to rotate.

7. The apparatus of claim 1, wherein during the period of time, the backup member is substantially continuously rotated.

8. The apparatus of claim 1, wherein during the period of time, the backup member is rotated in a plurality of discrete movements.

9. The apparatus of claim 1, wherein during the time the backup member is relatively slowly rotated, the controller causes the heat transfer member to be heated between about 150 degrees C. and about 170 degrees C.

10. An apparatus for an imaging device, comprising:

a fuser assembly for performing fusing operations within the imaging device, comprising a heater element and a backup roll; and a controller coupled to the fuser assembly, wherein during a period of time when the fuser assembly is not performing a fusing operation, the controller causes the heater element to heat and the backup roll to rotate at one or more speeds less than a fusing speed of the fuser assembly, wherein prior to the controller causing the heating element to heat and the backup roll to rotate at the one or more speeds less than a fusing speed of the fuser assembly, the controller estimates a temperature of the backup roll and determines whether the estimated temperature is below a predetermined temperature, and the controller causing the heater element to heat and the backup roll to rotate responsive to an affirmative determination, the estimating based at least in part upon a last measurement of the temperature of the backup roll and a time duration since the last measurement of the temperature of the backup roll.

11. The apparatus of claim 10, wherein the heater element is heated to a temperature that is less than a temperature for performing a fusing operation.

12. The apparatus of claim 10, wherein during the period of time the backup roll is rotated between about 0.3 revolutions per minute (rpm) and about 25 rpm.

13. The apparatus of claim 10, wherein the period of time is between about three minutes and about 15 minutes.

14. The apparatus of claim 10, wherein the period of time begins following an occurrence of an event associated with the imaging device.

15. The apparatus of claim 10, wherein during the period of time, the backup roll is rotated substantially continuously.

16. The apparatus of claim 10, wherein during the period of time, the backup roll is rotated in a series of discrete movements.

17. The apparatus of claim 10, wherein the controller is physically mounted to the fuser assembly.

18. The apparatus of claim 10, wherein following the heater element being heated and the backup roll being rotated, the controller estimates whether a temperature of the backup roll is above a predetermined temperature, and responsive to an affirmative estimation ceases heating the heater element and rotating the backup roll.

19. The apparatus of claim 18, wherein around the time of ceasing the heating of the heater element, the controller causes a fusing nip defined by the backup roll engaging the heater element to open.

20. The apparatus of claim 6, wherein around the time of the ceasing the activating of the heat transfer member, the controller causes the fusing nip to open.

21. The apparatus of claim 1, further comprising a door member, wherein the controller causes the heat transfer member to heat and the backup member to rotate at the at least one relatively slow speed in response to at least one of opening and closing the door member.

22. The apparatus of claim 10, further comprising a door member, wherein the controller causes the heater element to heat the backup roll to rotate at the at least one relatively slow speed in response to at least one of opening and closing the door member.

23. An apparatus, comprising:

a fuser assembly comprising a heat transfer member, a backup member positioned to engage the heat transfer member thereby defining a fusing nip therewith; and a controller coupled to the fuser assembly, wherein during a period of time when the fuser assembly is not performing a fusing operation, the controller activates the heat transfer member while causing the backup member to rotate at at least one relatively slow speed relative to a fusing speed of the fuser assembly, wherein the controller is physically mounted to the fuser assembly, the controller activating the heat transfer member and causing the backup member to relatively slowly rotate responsive to an affirmative estimation of a temperature of the backup member being below a predetermined temperature, the estimation based at least upon a last measurement of the temperature of the backup member and a time duration since the last measurement of the temperature of the backup member.

24. The apparatus of claim 1, wherein the causing the backup member to rotate at the at least one relatively slow speed relative to the fusing speed of the fuser assembly includes utilizing time-based commutation, and wherein the apparatus further comprises commutation logic circuitry for performing the time-based commutation, and a motor communicatively coupled to the controller and rotatably coupled to the backup member, the commutation logic circuitry utilizing one or more lookup tables and with each addressable location therein maintaining a motor drive value corresponding to a discrete position of the motor.

25. The apparatus of claim 10, wherein the causing the backup roll to rotate at the at least one relatively slow speed relative to the fusing speed of the fuser assembly includes utilizing time-based commutation, and wherein the apparatus further comprises commutation logic circuitry for performing the time-based commutation, and a motor communicatively coupled to the controller and rotatably coupled to the backup roll, the commutation logic circuitry utilizing one or more lookup tables and with each addressable location therein maintaining a motor drive value corresponding to a discrete position of the motor.

26. The apparatus of claim 23, wherein the causing the backup member to rotate at the at least one relatively slow speed relative to the fusing speed of the fuser assembly includes utilizing time-based commutation, and wherein the apparatus further comprises commutation logic circuitry for performing the time-based commutation, and a motor communicatively coupled to the controller and coupled to the backup member for rotation thereof, the commutation logic circuitry utilizing one or more lookup tables and with each addressable location therein maintaining a motor drive value corresponding to a discrete position of the motor.

27. The apparatus of claim 10, wherein an amount of predetermined portion of available power to be supplied to the heater element is substantially low during the standby mode.

28. The apparatus of claim 1, wherein the controller utilizes open loop control for the heat transfer member to be cycled between full power and no power for maintaining the temperature of the backup member during the standby mode.

29. The apparatus of claim 10, wherein the controller utilizes open loop control for the heater element to be cycled between full power and no power for maintaining the temperature of the backup roll during the standby mode.

30. The apparatus of claim 23, wherein the controller utilizes open loop control for the heat transfer member to be cycled between full power and no power for maintaining the temperature of the backup member during the standby mode.

* * * * *